US005573430A

United States Patent [19]

Hatagishi

[11] Patent Number: 5,573,430

[45] Date of Patent: Nov. 12, 1996

[54] PRESSURE CONNECTOR

[75] Inventor: Yuji Hatagishi, Shizuoka, Japan

[73] Assignee: Yazaki Corporation, Tokyo, Japan

[21] Appl. No.: 510,774

[22] Filed: Aug. 3, 1995

[30] Foreign Application Priority Data

Aug. 17, 1994 [JP] Japan ..... 6-193358

[51] Int. Cl.[6] ..... H01R 13/502

[52] U.S. Cl. ..... 439/701; 439/400; 439/598

[58] Field of Search ..... 439/701, 397, 439/398, 399, 400, 404, 406, 686

[56] References Cited

U.S. PATENT DOCUMENTS

| | | | |
|---|---|---|---|
| 4,277,124 | 7/1981 | Loose et al. | 439/398 |
| 4,354,719 | 10/1982 | Weidler | 439/398 |
| 5,122,077 | 6/1992 | Maejima et al. | 439/398 |
| 5,320,555 | 6/1994 | Okabe | 439/701 |

FOREIGN PATENT DOCUMENTS 62-128460 6/1987 Japan .

6-13056 2/1994 Japan .

*Primary Examiner*—Neil Abrams
*Assistant Examiner*—Yong Kim
*Attorney, Agent, or Firm*—Sughrue, Mion, Zinn, Macpeak & Seas

[57] ABSTRACT

A cover, which is to be fitted onto a housing from the front of the housing and constructed of a single part, is releasably fitted over the housing from outside. Contact projections and vibration preventing projections are formed on inner surfaces of the cover, each contact projection being located above a corresponding partition wall and each vibration preventing projection being located in a corresponding terminal accommodating chamber at the time the cover is fixed to the housing. A guide projection is formed at an upper edge of each partition wall, the guide projection coming in contact with the corresponding contact projection at the time the cover is being fitted onto said housing so that a portion of the cover on which the corresponding vibration preventing projection is formed is elastically deformed to thereby cause the vibration preventing projection to move away from a corresponding pressure terminal.

4 Claims, 5 Drawing Sheets

PRESSURE CONNECTOR

BACKGROUND OF THE INVENTION

The present invention relates to a pressure connector designed to conduct electricity between pressuring blades and the conductor of an electric wire by pressing the electric wire into the pressuring blades. The present invention is directed, in particular, to an improved cover member structure for increasing the retainability of the electric wire at a pressuring part.

A pressure connector so designed that a sheathed electric wire is pressed into the pressuring blades and the sheath thereof is cut to cause the conductor of the wire to come in pressure contact with the pressuring blades for conduction is advantageous in mass production, but is disadvantageous in keeping the electric wire well retained at the pressuring part against vibrations and the like.

An exemplary pressure connector that has overcome such disadvantage by providing an electric wire contact means at the pressuring part will be described with reference to FIGS. 8 to 10. FIG. 8 is an exploded perspective view of a conventional pressure connector; FIG. 9 is a sectional view showing a terminal accommodating chamber portion after the connector has been assembled; and FIG. 10 is a front view showing a condition in which an electric wire is in pressure contact.

A housing 3 having openings of a plurality of terminal accommodating chambers 1 formed on both upper and lower surfaces thereof is assembled while interposed by a pair of covers *5a, 5b* from above and below. A plurality of electric wire contact projections 7 corresponding to the terminal accommodating chambers 1 are projected on the inner walls of the covers *5a, 5b*. Each electric wire contact projection 7 is interposed between pressuring blades *9a, 9b* of a pressure terminal 9 with the covers *5a, 5b* being assembled to the housing 3 as shown in FIG. 9, the pressure terminal 9 being accommodated in the terminal accommodating chamber 1. A sheath 11 (see FIG. 10) is cut by the pressuring blades *9a, 9b*, and the electric wire contact projection comes in contact with an electric wire 15 whose conductor 13 is in conduction.

As a result, the vertical displacement of the wire (in directions indicated by arrows a in FIG. 10) caused by vibrations and the like is regulated, which in turn improves the retainability of the electric wire 15 and hence increases the reliability of electric contact at the pressuring part.

However, the conventional pressure connector is designed to interpose each electric wire contact projection 7 between the pressuring blades *9a, 9b* of the pressure terminal 9, which is accommodated in the corresponding terminal accommodating chamber 1, by providing the electric wire contact projections 7 on both a pair of upper and lower covers *5a, 5b* and assembling the covers *5a, 5b* to the housing. Therefore, two parts are required to form the cover member, and this increases the number of parts, thereby not only increasing the cost of manufacture, but also making the parts control cumbersome.

Further, the two-part cover structure requires that the electric wires 15 be placed in order in an electric wire insertion portion 17 (see FIG. 8) so that the electric wires 15 led out of the plurality of upper and lower terminal accommodating chambers 1 will not be pinched between the covers *5a, 5b* during the operation of assembling the cover, which has made assembling operability extremely impaired.

SUMMARY OF THE INVENTION

The present invention has been made in view of the aforementioned circumstances. An object of the invention is, therefore, to provide a pressure connector capable not only of regulating the undesired movement of electric wires in the upper and lower terminal accommodating chambers, but also of preventing the electric wires from being pinched by means of a cover constructed of a single part, thereby contributing to reducing the cost of manufacture as well as improving the assembling operability.

To achieve the above object, the present invention provides a pressure connector which has terminal accommodating chambers defined by erecting partition walls on a horizontal board of a housing, in which electric wires are led out of rear portions of the terminal accommodating chambers, the electric wires extending from pressure terminals accommodated in the terminal accommodating chambers. In such a pressure connector, a boxlike cover is releasably fitted over the housing from outside, the cover being fitted onto the front of the housing; contact projections and vibration preventing projections are formed, each contact projection being located above the corresponding partition wall and each vibration preventing projection being located in the corresponding terminal accommodating chamber and brought into contact with the electric wire at the time the cover is fitted; and guide projections are formed on upper edges of the partition walls, respectively, each guide projection coming in contact with the corresponding contact projection at the time the cover is being fitted so that a portion of the cover having the corresponding vibration preventing projection formed is elastically deformed to thereby cause the vibration preventing projection to move away from the pressure terminal.

When the contact projection of the cover comes in contact with the corresponding guide projection as a result of fitting of the cover, the portion of the cover in which the vibration preventing projection and the contact projection are formed is elastically deformed to cause the portion to move away from the guide projection. This raises the vibration preventing projection to such a height as to pass over the pressure terminal, thereby avoiding the interference of the vibration preventing projection with the pressure terminal. When the cover is further fitted onto the housing, the contact projection is disengaged from the guide projection to return the cover, and simultaneously with the contact projection being lowered to the original position, the vibration preventing projection having passed over the pressure terminal is also lowered, thereby causing the vibration preventing projection to come in contact from above with the electric wire that has been pressed into the pressuring part.

BRIEF DESCRIPTION OF THE DRAWINGS

FIG. 7(*c*) shows a condition in which a vibration preventing projection is located in a pressuring part of the terminal.

DETAILED DESCRIPTION OF THE INVENTION

A pressure connector, which is a preferred embodiment of the present invention, will now be described in detail with reference to the drawings.

Figure 1:
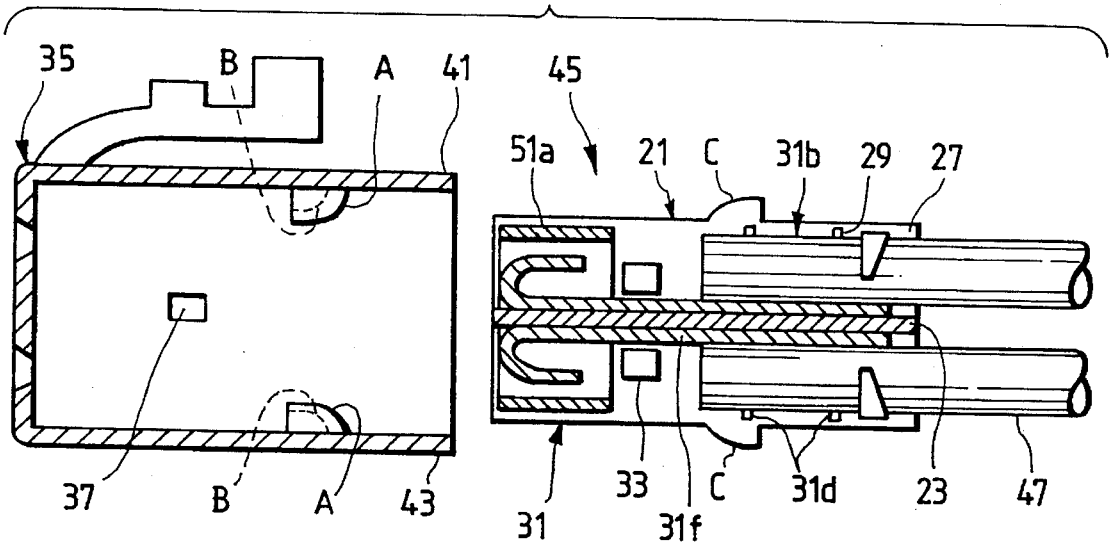
FIG. 1 is a sectional side view showing a pressure connector of the invention before assembled.
Figure 2:
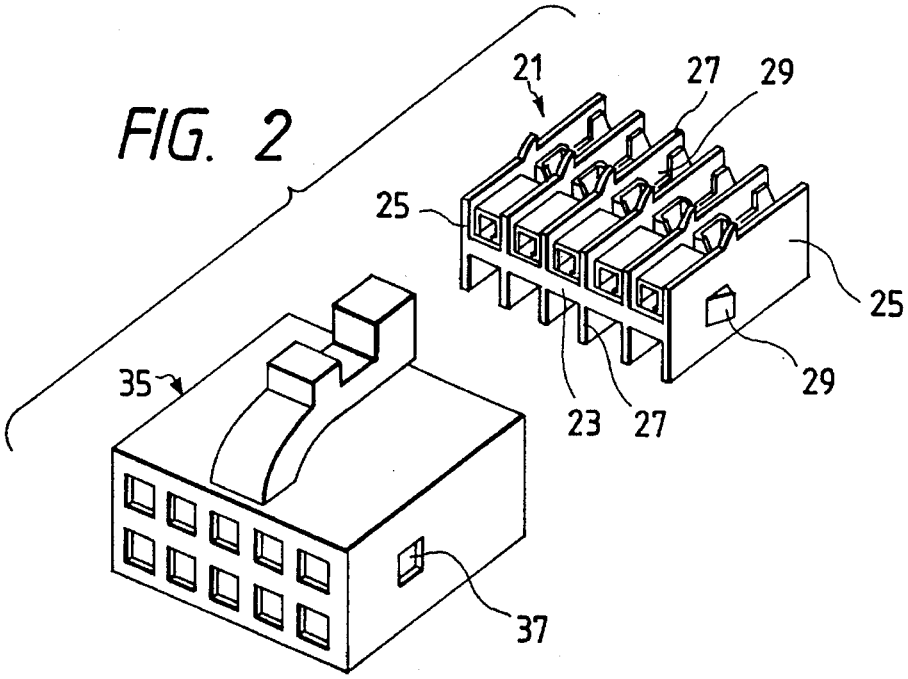
FIG. 2 is a perspective view showing the pressure connector of the invention before assembled.
Figure 3:
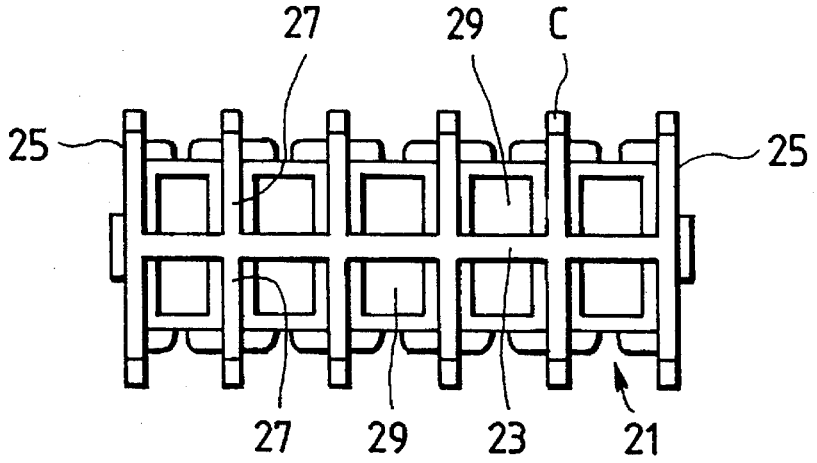
FIG. 3 is a front view showing a housing of the pressure connector of the invention.
Figure 4:
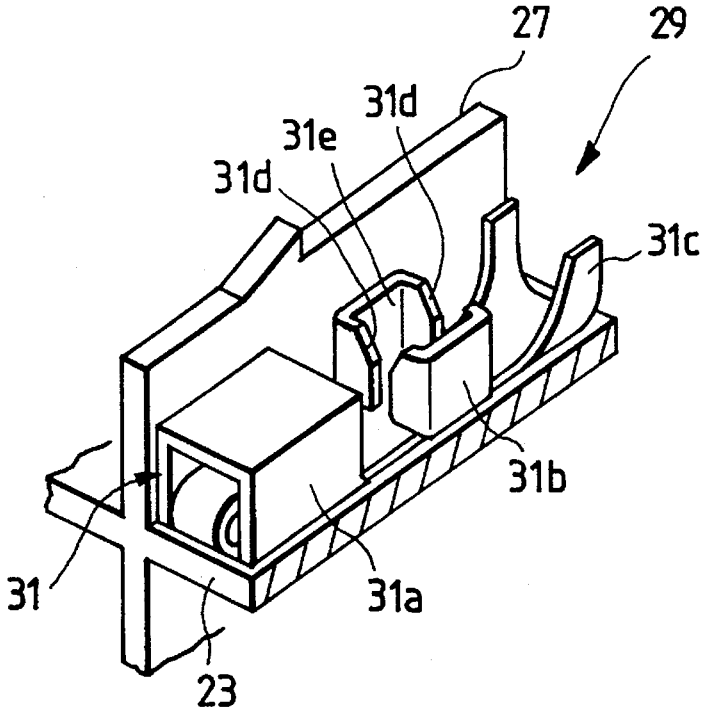
FIG. 4 is an enlarged view showing a terminal accommodating chamber of the pressure connector of the invention.
Figure 5:
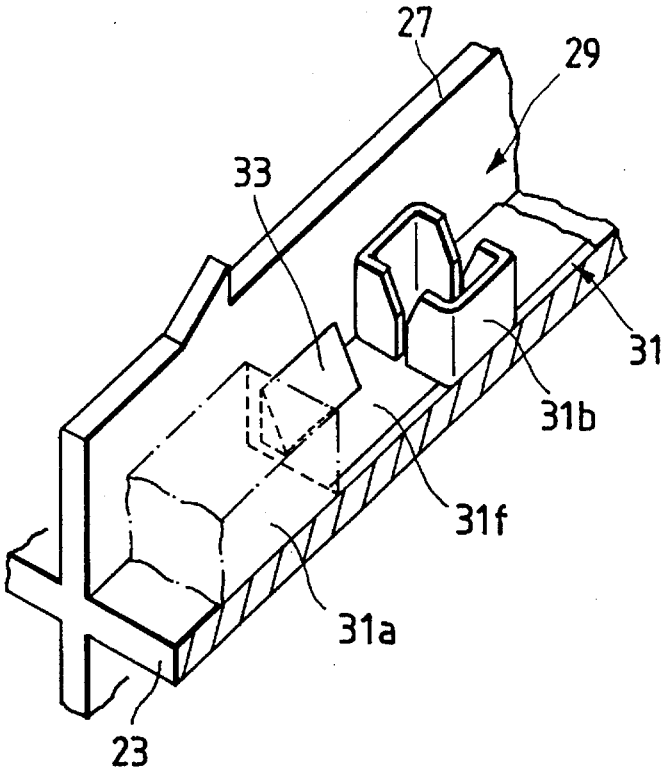
FIG. 5 is a perspective view showing a terminal in the fixed condition in the pressure connector of the invention.
Figure 6:
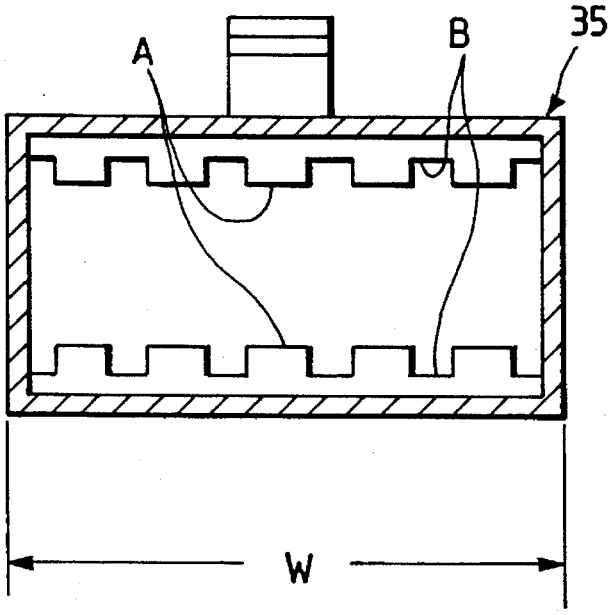
FIG. 6 is a sectional view showing a cover of the pressure connector of the invention, FIGS. 7(*a*) to 7(*c*) are diagrams illustrative of the operation of fitting of the cover in the pressure connector of the invention, in which FIG. 7(*a*) shows a condition before a contact projection comes in contact with a guide projection.

FIG. 1 is a sectional side view showing the pressure connector of the invention before assembled; FIG. 2 is a perspective view showing the pressure connector of the invention before assembled; FIG. 3 is a front view of a housing; FIG. 4 is an enlarged view showing a terminal accommodating chamber; FIG. 5 is a perspective view showing a terminal that is in the fixed condition; and FIG. 6 is a sectional view showing a cover.

As shown in FIG. 2, side plates 25 are arranged at both sides of a horizontal board 23 of a housing 21, so that the horizontal board 23 partitions a space interposed between the side plates 25 into two parts, upper and lower. A plurality of partition walls 27 that run in parallel with the side plates 25 are erected on both upper and lower surfaces of the horizontal board 23, so that the partition walls 27 divide a space interposed between the side walls 25 into a plurality of terminal accommodating chambers 29. Therefore, as shown in FIG. 3, a plurality of terminal accommodating chambers 29 are arranged at an equal distance vertically as well horizontally in the housing 21 by the horizontal board 23, the side plates 25, and the partition walls 27 that are set up in the form of a lattice.

As shown in FIG. 4, a pressure terminal 31 is accommodated in each of the terminal accommodating chambers 29. The pressure terminal 31 includes an electric contact part 31*a* formed at the front end, a pressuring part 31*b* formed in the middle, and an electric wire pinching part 31*c* formed at the rear end. The pressuring part 31*b* has two parallelly running pressuring blades 31*c* arranged along the length of the terminal so as to interpose a gap 31*e* therebetween.

As shown in FIG. 5, a terminal mounting projection 33 is formed so as to project from a lower portion of the partition wall 27 of each terminal accommodating chamber 29. The terminal mounting projection 33 is elastically deformed by the pressing of the pressure terminal 31 from above, and a flat plate part 31*f* between the electric contact part 31*a* and the pressuring part 31*b* is pinched with the terminal mounting projection 33 and the horizontal board 23. In addition that the flat plate part 31*f* is thus pinched, the interposition of the terminal mounting projection 33 between the electric contact part 31*a* and the pressuring part 31*b* contributes to blocking the pressure terminal 31 from slipping off in the longitudinal direction of the terminal accommodating chamber 29 as well as in the vertical direction.

As shown in FIGS. 1 and 2, a boxlike cover 35 made of a synthetic resin is designed to be fitted onto the housing from the front thereof. The cover 35 is fixed to the housing 21 by engaging fixing holes 37 formed in the side plates of the cover 35 with cover mounting projections 39 projecting from the side plates 25 of the housing 21.

Large vibration preventing projections A and small contact projections B are formed alternately so as to extend in the width direction W (see FIG. 6) on the inner surfaces of an upper plate 41 and a lower plate 43 of the cover 35, respectively. The surfaces of each vibration preventing projection A and each contact projection B are tapered toward the rear end side of the cover 35. When the cover 35 is fitted over the housing 21, the vibration preventing projections A are aligned with the terminal accommodating chambers 29, whereas the contact projections B are aligned with the partition walls 27.

On the other hand, guide projections C (see FIG. 3) are formed on the upper edges of the respective partition walls 27. The surface of each guide projection C is tapered toward the front side of the housing 21. The guide projections C and the contact projections B are designed so as to come in contact with each other at the tapered surfaces thereof when the cover is fitted onto the housing. Therefore, when the cover 35 with the contact projections B being in contact with the guide projections C is further pushed in, the portion having the vibration preventing projections A and the forming portion of the contact projections B are elastically deformed so as to move away from the guide projections C, respectively.

The housing 21, the partition walls 27, the terminal mounting projections 33, the cover 35, the vibration preventing projections A, the contact projections B, and the guide projections C are the main members or parts constituting the pressure connector 45.

Figure 7A:
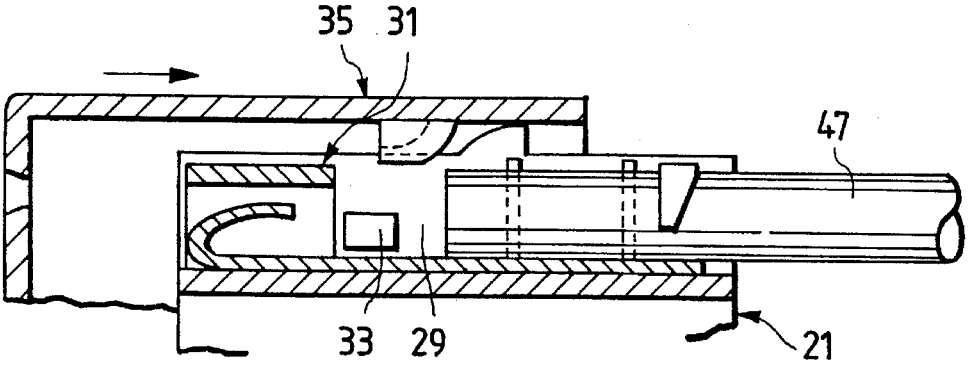
FIG. 7(*b*) shows a condition at the time the contact projection comes in contact with the guide projection.
Figure 7B:
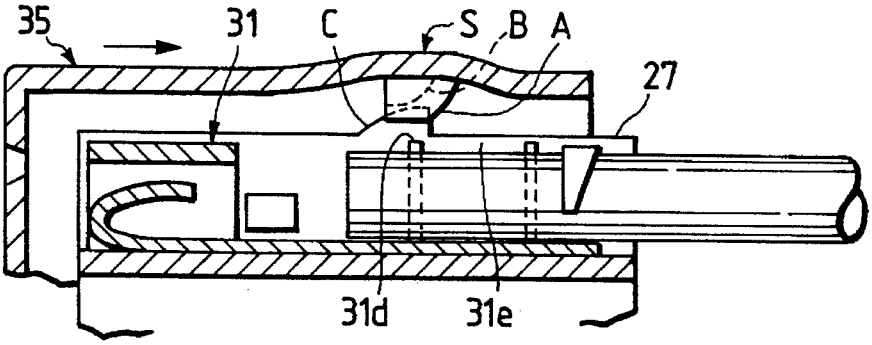
Figure 7C:
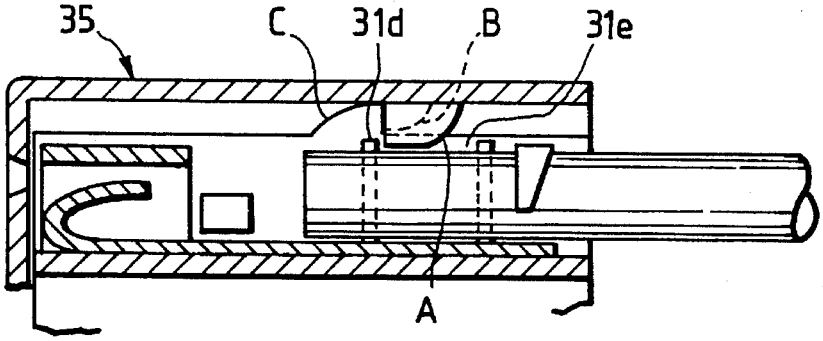
Figure 8:
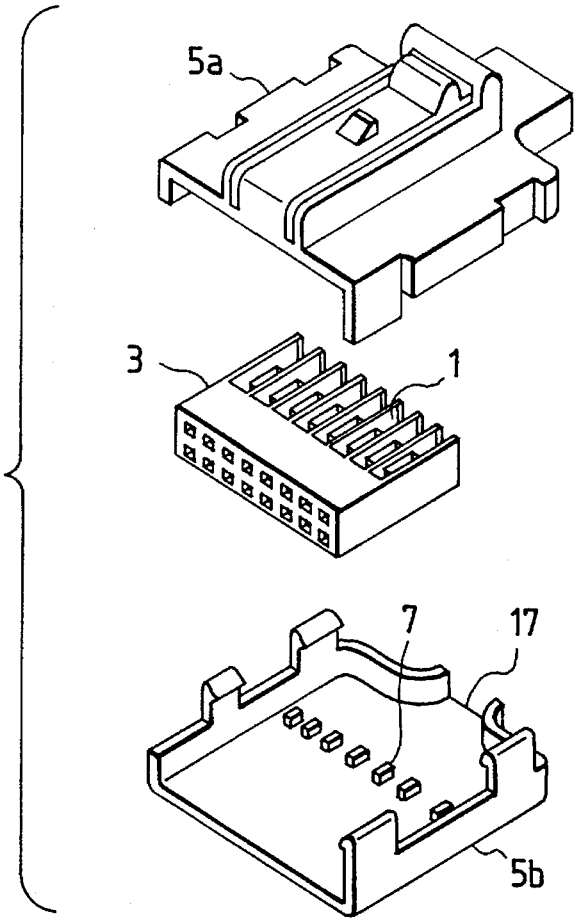
FIG. 8 PRIOR ART
FIG. 8 is an exploded perspective view of a conventional pressure connector.
Figure 9:
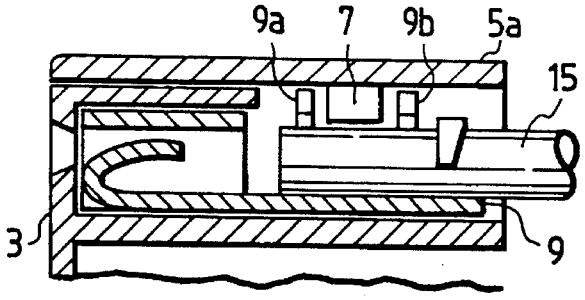
FIG. 9 PRIOR ART
FIG. 9 is a sectional view showing a terminal accommodating chamber portion after the conventional connector has been assembled.
Figure 10:
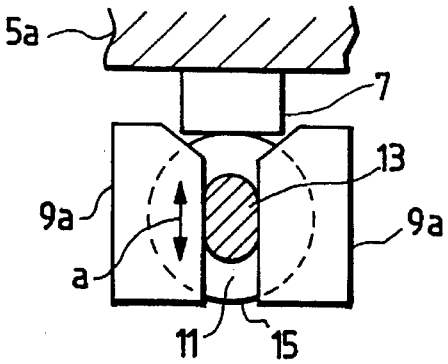
FIG. 10 PRIOR ART
FIG. 10 is a front view showing a condition in which an electric wire is in pressure contact in the conventional pressure connector.

The operation of the thus constructed pressure connector 45 will be described with reference to FIGS. 7(*a*) to 7(*c*). FIGS. 7(*a*) to 7(*c*) are diagrams explaining the operations at the fitting of the cover, in which FIG. 7(*a*) shows a condition before the contact projection B comes in contact with the guide projection C; FIG. 7(*b*) shows a condition at the time the pressure groove B comes in contact with the guide projection C; and FIG. 7(*c*) shows a condition in which the vibration preventing projection A is located at the pressuring part of the terminal.

An electric wire 47 is pressured to the pressure terminal 31 that is fixed to the corresponding terminal accommodating chamber 29 by the terminal mounting projection 33.

As shown in FIG. 7(*a*), the cover 35 is fitted onto the housing 21 from the front of the housing 21 that has the electric wire 47 led out of the rear thereof.

As the operation of fitting the cover 35 progresses, the contact projection B of the cover 35 comes in contact with the corresponding guide projection C of the partition wall 27 as shown in FIG. 7(*b*). When the cover is still further pressed toward the fitting direction under this condition, the portion S of the cover 35 in which the vibration preventing projection A and the contact projection B are formed is elastically deformed to move away from the guide projection C. As a result, the vibration preventing projection A is raised to such a height as to pass over the pressuring blades 31*d* of the pressure terminal 31, so that the interference of the vibration preventing projection A with the pressuring blades 31*d* can be avoided.

As the cover 35 is still further pressed, the contact projection B comes out of contact with the guide projection C to return the cover 35 as shown in FIG. 7(*c*), which causes the contact projection B to be lowered to the original position, thereby engaging the contact projection B with the guide projection C at the rear surfaces thereof. As a result, the housing 21 and the cover 35 are firmly fixed so as to be unreleasable from each other owing also to the engagement of the fixing holes 37 with the cover mounting projections 39.

On the other hand, simultaneously with the lowering of the contact projection B to the original position, the vibration preventing projection A, which passes over the pressuring blade 31*d*, is also lowered, and the vibration preventing projection A comes in contact with the electric wire 47 pressed into the gap 31*e* between the pressuring blades 31*d*. As a result, the downward movement of the electric wire 47 caused by vibrations and the like is regulated, which contributes to increasing the retainability of the electric wire 47.

According to the aforementioned pressure connector 45, the cover 35, which is a single part, is releasably fitted over the housing 21; the vibration preventing projections A are formed on the cover 35; and the contact projections B and the guide projections C are formed on the cover 35 and the housing 21, respectively, so that the vibration preventing projections A can pass over the pressuring blades 31*d* during the fitting movement of the cover. Therefore, the vibration preventing structure for the electric wires can be implemented with a small number of parts. As a result, parts cost reduction and easy parts control owing to the reduction in the number of parts can be achieved. In addition, there is no need for taking care of the problem of pinching the electric wires during the operation of assembling the two-part cover structure, which remarkably contributes to simplifying the assembling operation.

The exemplary structure in which the housing 21 and the cover 35 are fixed so as to be unreleasable from each other through the engagement of the contact projection B with the corresponding guide projection C at the rear surfaces thereof in the aforementioned embodiment. However, the housing 21 and the cover 35 may, of course, be constructed so as to be fixed to each other only through the engagement of the fixing holes 37 with the cover mounting projections 39.

As described in the foregoing in detail, the pressure connector of the invention is characterized as not only releasably arranging a cover, which is a single part, but also arranging contact projections and guide projections on the cover and the housing, respectively, so that vibration preventing projections can pass over pressure terminals during the fitting movement of the cover. Therefore, not only the displacement of electric wires can be regulated by the cover, which is a single part, but also the pinching state of the electric wires during the assembling operation can be avoided. As a result, the cost of manufacture can be reduced, and the assembling operation can be remarkably simplified.

What is claimed is:

1. A pressure connector, comprising:

a horizontal board;

partition walls erecting on said horizontal board, said horizontal board and said partition walls constituting a housing;

terminal accommodating chambers defined by said horizontal board and said partition walls;

pressure terminals accommodated in said terminal accommodating chambers, electric wires extending from said pressure terminals and being led out of rear portions of said terminal accommodating chambers;

a boxlike cover releasably fitted to an outside of said housing, said cover being fitted onto said housing from a front portion of said housing;

contact projections formed on an inner surface of said cover, said contact projections being located above said partition walls when said cover is fitted to said housing;

vibration preventing projections formed on said inner surface of said cover, said vibration preventing projection being located in said terminal accommodating chambers and brought into contact with said electric wire at the time when said cover is fitted to said housing; and guide projections formed on upper edges of said partition walls, respectively, said guide projection coming in contact with said contact projections at the time when said cover is being fitted onto said housing so that a portion of said cover on which said vibration preventing projections are formed is elastically deformed to thereby cause said vibration preventing projections to move away from said pressure terminal.

2. A pressure connector according to claim 1, wherein said cover and said housing is made unreleasable from each other through said contact projections and said guide projections which are engaged with each other when said cover has been fitted to said housing.

3. A pressure connector according to claim 1, wherein each of said pressure terminal includes an electric contact part, a pressuring part and an electric wire pinching part.

4. A pressure connector according to claim 3, further comprising a terminal mounting projection formed on a lower portion of each of said partition walls between said electric contact part and said pressuring part.

* * * * *